US006983493B1

(12) United States Patent
Shaumyan

(10) Patent No.: US 6,983,493 B1
(45) Date of Patent: Jan. 10, 2006

(54) RETRACTABLE TABLE TOP FOR A TOILET

(76) Inventor: Rafik Shaumyan, 916 E. Elk Ave. #4, Glendale, CA (US) 91205

( * ) Notice: Subject to any disclaimer, the term of this patent is extended or adjusted under 35 U.S.C. 154(b) by 16 days.

(21) Appl. No.: 10/801,029

(22) Filed: Mar. 15, 2004

(51) Int. Cl.
*E03D 11/00* (2006.01)

(52) U.S. Cl. ..... 4/254

(58) Field of Classification Search ..... 4/254, 4/480, 573.1, 578.1; 108/48, 137, 143
See application file for complete search history.

(56) References Cited

U.S. PATENT DOCUMENTS 2,243,264 A * 5/1941 Stromblad ..... 4/254
3,090,051 A * 5/1963 Oakland ..... 4/254
3,209,375 A * 10/1965 Parsons ..... 4/237
4,098,486 A 7/1978 Hornsby
4,602,759 A 7/1986 Hwebber
4,825,779 A 5/1989 Simms
5,329,645 A * 7/1994 Fossum et al. ..... 4/254
D368,819 S 4/1996 Lemmons
5,526,943 A 6/1996 Thompson
5,687,431 A * 11/1997 Garrett ..... 4/254
5,761,753 A 6/1998 Talbert
6,032,586 A 3/2000 Reyes

* cited by examiner

*Primary Examiner*—Charles E. Phillips

(57) ABSTRACT

A device for providing a working surface is positionable adjacent a toilet and includes a table having substantially planar top and bottom surfaces and a plurality of elongated legs having opposed end portions attached thereto and engageable with a ground surface. Such a plurality legs are pivotally connected to the lower surface of the table and are movable between folded and extended positions. The device further includes a support member having a rear end portion that is securable to a wall adjacent a toilet and extends outwardly therefrom. The support member further has a front end portion spaced from the rear end portion and is pivotally connected to the table so that the table can be selectively moved between up and down positions about the front end portion.

12 Claims, 3 Drawing Sheets

RETRACTABLE TABLE TOP FOR A TOILET

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a table top and, more particularly, to a retractable table top for a toilet seat.

2. Prior Art

The toilet seat can more rightly be called "the throne" if certain conditions are met above and beyond the simple support and flush provisions. A supply of toilet paper needs to be furnished and at a convenient location or locations, not a marginally accessible location. A supply of reading material from which a selection can be made is usually welcome, and for some an ashtray, cigarettes and matches are needed. Some may prefer to prepare notes such as shopping lists, and these will need pencil and notepaper and backing for the note paper.

Accordingly, the use of toilet accessories is known in the prior art. More specifically, toilet accessories heretofore devised and utilized are known to consist basically of familiar, expected and obvious structural configurations, notwithstanding the myriad of designs encompassed by the crowded prior art, which have been developed for the fulfillment of countless objectives and requirements.

For example, the toilet stalls in public rest rooms are conventionally cramped and offer little, if any, space for the storage of personal items such as reading material and the like. Bathrooms in many homes have a similar disadvantage.

Accordingly, a need remains for a toilet seat accessory that overcomes the above-noted shortcomings.

BRIEF SUMMARY OF THE INVENTION

In view of the foregoing background, it is therefore an object of the present invention to provide a retractable table top for a toilet seat. These and other objects, features, and advantages of the invention are provided by a device for providing a working surface while a user is seated on a toilet. The device includes a table having substantially planar top and bottom surfaces and a centrally disposed longitudinal axis. The table includes a plurality of opposed edge portions equally spaced from the axis and extending substantially parallel thereto.

The table further includes a plurality of opposed end portions integral with the plurality of edge portions and a plurality of elongated legs with opposed end portions attached thereto and engageable with a ground surface. Such a plurality of legs are pivotally connected to the lower surface of the table and movable between folded and extended positions. The table further has a plurality of elongated support rods secured to the bottom surface and adjacent the plurality of end portions.

A support member positionable on alternate sides of a toilet seat includes a rear end portion securable to a wall adjacent a toilet and extending outwardly and forwardly therefrom. The support member further includes a telescopic front end portion that is connected to the rear end portion that is extendable along a substantially horizontal plane. Such a front end portion is removably attachable to one of the plurality of support rods so that the table can be selectively moved between up and down positions and pivoted thereabout. The rear end portion of the support member includes a pair of spaced arms extending outwardly therefrom and along a horizontal plane for receiving the table therebetween during non-operating conditions. A bracket with front and rear surfaces is connected to the rear end portion and a wall respectively.

Advantageously, the front end portion of the support member further includes a female portion and a male portion slidably engageable therein along a substantially parallel path so that the table can be telescopically extended between retracted and extended positions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
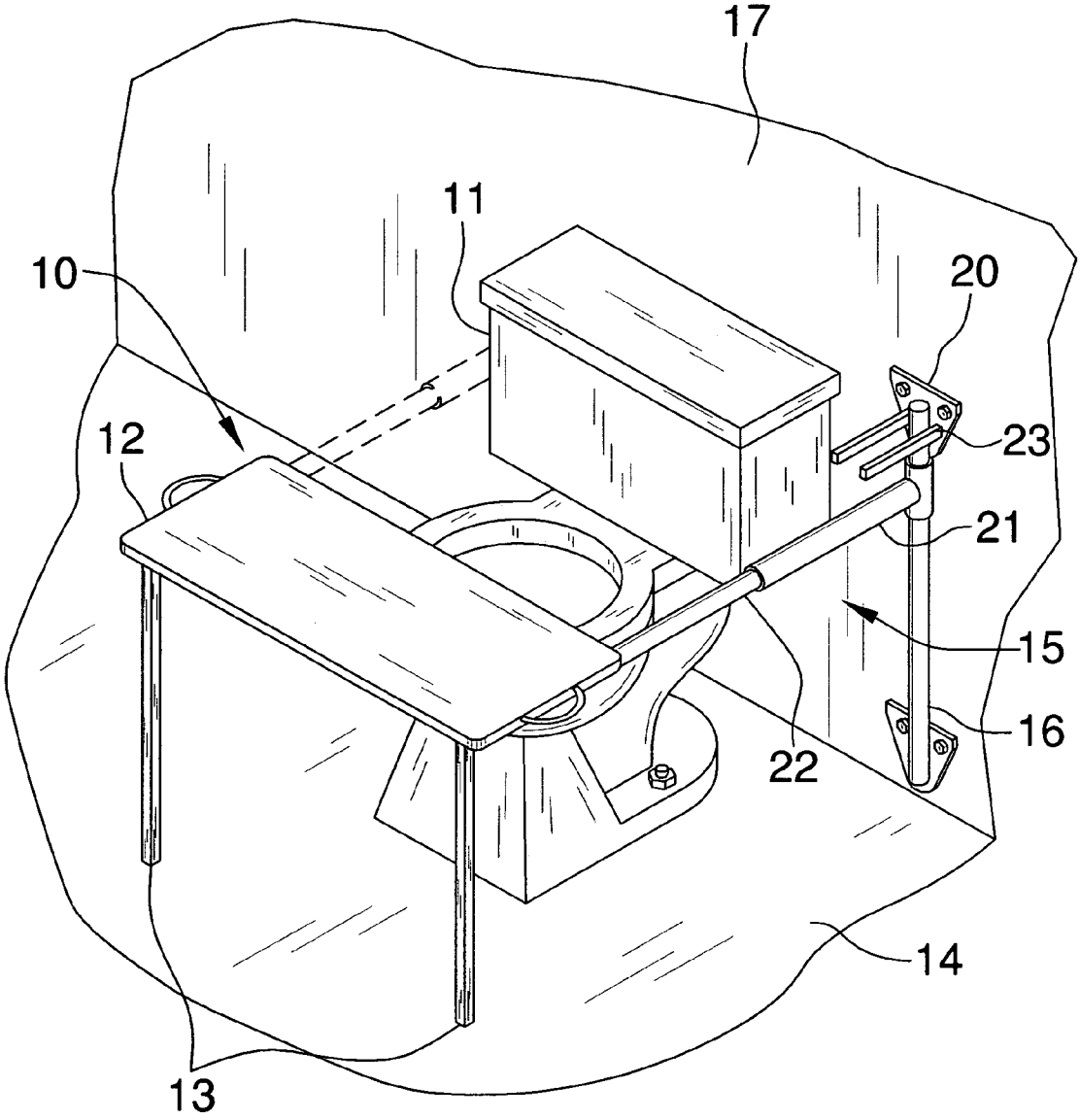
FIG. 1 is a perspective view showing an apparatus for supporting reading and writing materials, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–5 by the reference numeral 10 and is intended to provide a retractable table for a toilet seat. It should be understood that the device 10 may be used for various services and therefore should not be construed as limited to being used only for bathroom use.

Referring initially to FIG. 1, the device 10 includes a table 12 having substantially planar top and bottom surfaces and a centrally disposed longitudinal axis (not shown). The table 12 includes a plurality of opposed edge portions equally spaced from the axis and extending substantially parallel thereto.

The table 12 further includes a plurality of opposed end portions integral with the plurality of edge portions and a plurality of elongated legs 13 with opposed end portions attached thereto and engageable with a ground surface 14. Such a plurality of legs 13 are pivotally connected to the lower surface of the table 12 and movable between folded and extended positions. The table 12 further has a plurality of elongated support rods 19 secured to the bottom surface and adjacent the plurality of end portions, best shown in FIG. 2.

Figure 2:
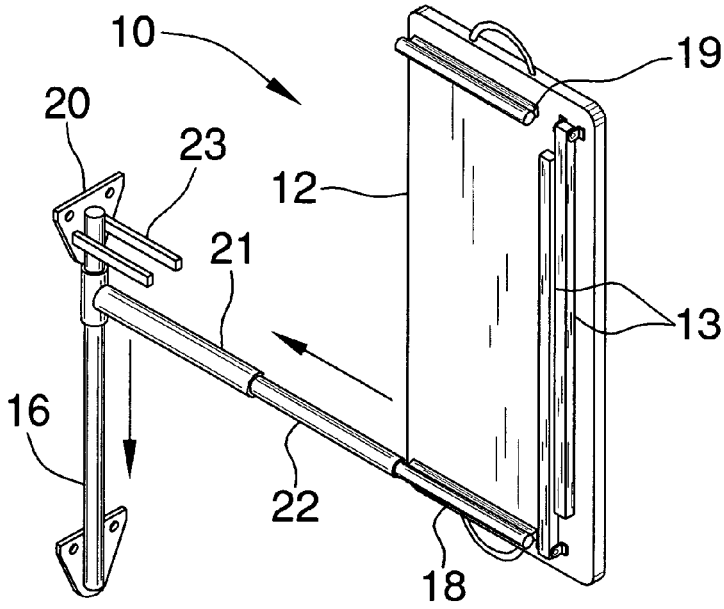
FIG. 2 is a perspective view showing the apparatus of FIG. 1 at a folded position.

Referring to the combination of FIGS. 1 and 2, a support member 15 positionable on alternate sides of a toilet seat includes a rear end portion 16 securable to a wall 17 adjacent a toilet 11 and extending outwardly and forwardly therefrom. The support member 15 further includes a telescopic front end portion 18 that is connected to the rear end portion 16 that is extendable along a substantially horizontal plane. Such a front end portion 18 is removably attachable to one of the plurality of support rods 19 so that the table 12 can be selectively moved between up and down positions and pivoted thereabout.

Figure 3:
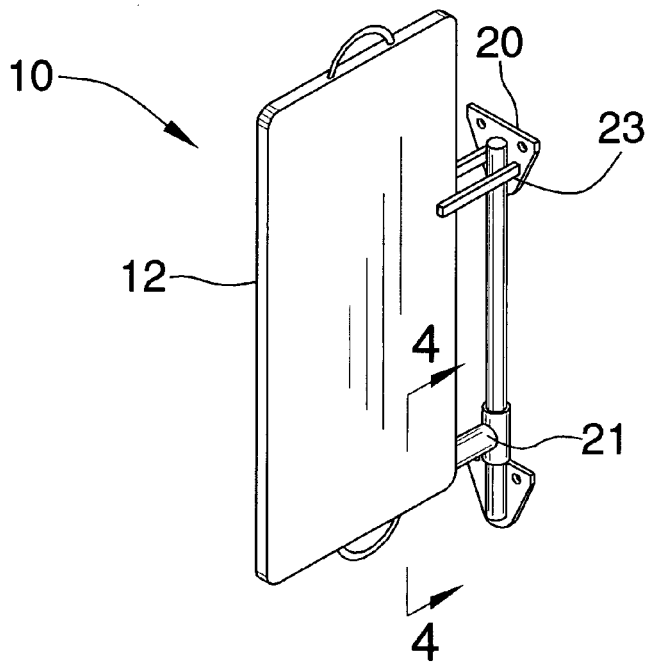
FIG. 3 is perspective view showing the apparatus of FIG. 2 at a retracted position.

The rear end portion 16 of the support member 15 includes a pair of spaced arms 23 extending outwardly therefrom and along a horizontal plane for receiving the table 12 therebetween during non-operating conditions, best shown in FIG. 3. A bracket 20 with front and rear surfaces is connected to the rear end portion 16 and a wall 17 respectively.

Figure 4:
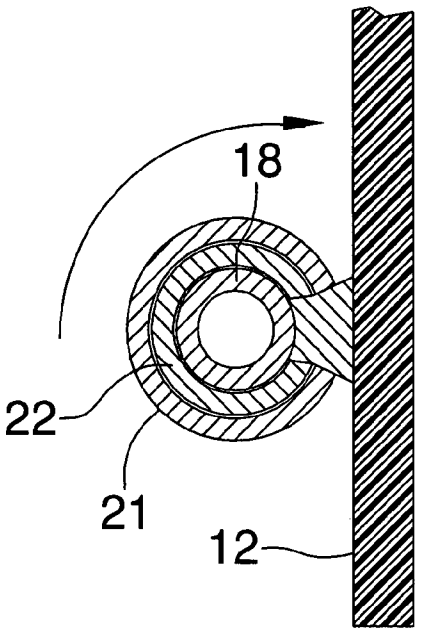
FIG. 4 is an enlarged cross-sectional view showing the telescopic portion of the support member.
Figure 5:
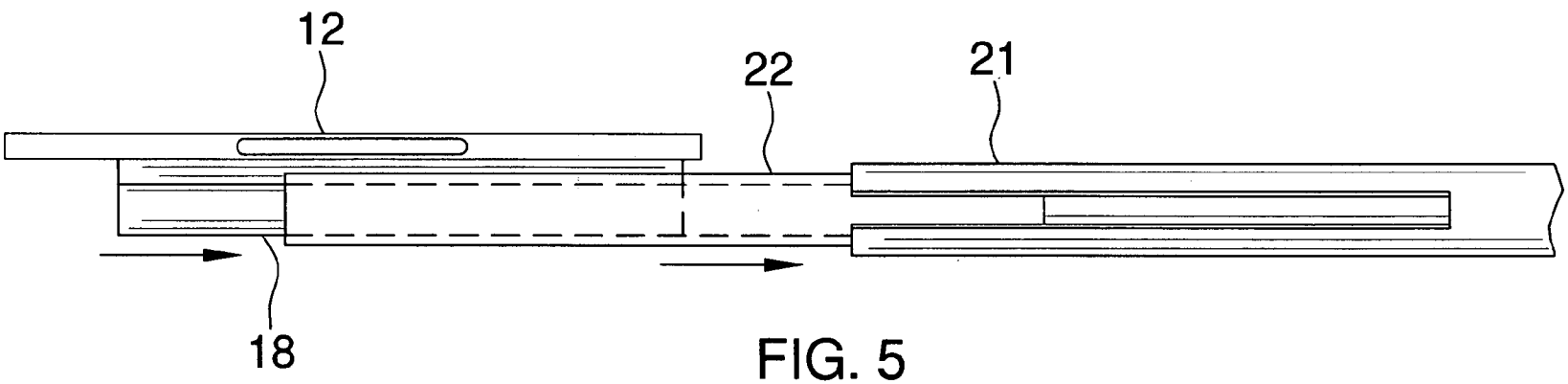
FIG. 5 is an enlarged side-elevational view showing the male and female portions of the support member.

Now referring to FIGS. 4 and 5, the front end portion 18 of the support member 15 further includes a female portion 21 and a male portion 22 slidably engageable therein and along a substantially parallel path so that the table 12 can be telescopically extended between retracted and extended positions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A device for providing a working surface while a user is seated on a toilet, said device comprising:

a table having substantially planar top and bottom surfaces and a centrally disposed longitudinal axis, said table including a plurality of opposed edge portions equally spaced from the axis and extending substantially parallel thereto, said table further including a plurality of opposed end portions integral with said plurality of edge portions, said table further including a plurality of elongated legs having opposed end portions attached thereto and engageable with a ground surface respectively, said table further having a plurality of elongated support rods secured to said bottom surface and adjacent said plurality of end portions respectively; and a support member positionable on alternate sides of a toilet seat and comprising a rear end portion securable to a wall adjacent a toilet and extending outwardly and forwardly therefrom, and a telescopic front end portion connected to said rear end portion and being extendable along a substantially horizontal plane, said front end portion being removably attachable to one said plurality of support rods so that said table can be selectively moved between up and down positions and pivoted thereabout.

2. The device of claim 1, wherein said plurality legs are pivotally connected to said lower surface of said table and movable between folded and extended positions.

3. The device of claim 1, wherein said support member further comprises:

a bracket having front and rear surfaces connected to said rear end portion and a wall respectively.

4. The device of claim 1, wherein said front end portion of said support member further comprises:

a female portion and a male portion slidably engageable therein along a substantially parallel path so that said table can be telescopically extended between retracted and extended positions.

5. The device of claim 1, wherein said rear end portion of said support member comprises:

a pair of spaced arms extending outwardly therefrom and along a horizontal plane and for receiving said table therebetween during non-operating conditions.

6. A device for providing a working surface while a user is seated on a toilet, said device comprising:

a table having substantially planar top and bottom surfaces and a centrally disposed longitudinal axis, said table including a plurality of opposed edge portions equally spaced from the axis and extending substantially parallel thereto, said table further including a plurality of opposed end portions integral with said plurality of edge portions, said table further including a plurality of elongated legs having opposed end portions attached thereto and engageable with a ground surface respectively, said plurality of legs being pivotally connected to said lower surface of said table and movable between folded and extended positions, said table further having a plurality of elongated support rods secured to said bottom surface and adjacent said plurality of end portions respectively; and a support member positionable on alternate sides of a toilet seat and comprising a rear end portion securable to a wall adjacent a toilet and extending outwardly and forwardly therefrom, and a telescopic front end portion connected to said rear end portion and being extendable along a substantially horizontal plane, said front end portion being removably attachable to one said plurality of support rods so that said table can be selectively moved between up and down positions and pivoted thereabout.

7. The device of claim 6, wherein said support member further comprises:

a bracket having front and rear surfaces connected to said rear end portion and a wall respectively.

8. The device of claim 6, wherein said front end portion of said support member further comprises:

a female portion and a male portion slidably engageable therein along a substantially parallel path so that said table can be telescopically extended between retracted and extended positions.

9. The device of claim 6, wherein said rear end portion of said support member comprises:

a pair of spaced arms extending outwardly therefrom and along a horizontal plane and for receiving said table therebetween during non-operating conditions.

10. A device for providing a working surface while a user is seated on a toilet, said device comprising:

a table having substantially planar top and bottom surfaces and a centrally disposed longitudinal axis, said table including a plurality of opposed edge portions equally spaced from the axis and extending substantially parallel thereto, said table further including a plurality of opposed end portions integral with said plurality of edge portions, said table further including a plurality of elongated legs having opposed end portions attached thereto and engageable with a ground surface respectively, said plurality of legs being pivotally connected to said lower surface of said table and movable between folded and extended positions, said table further having a plurality of elongated support rods secured to said bottom surface and adjacent said plurality of end portions respectively; and a support member positionable on alternate sides of a toilet seat and comprising a rear end portion securable to a wall adjacent a toilet and extending outwardly and forwardly therefrom, said rear end portion including a bracket having front and rear surfaces connected to said rear end portion and a wall respectively, and a telescopic front end portion connected to said rear end portion and being extendable along a substantially horizontal plane, said front end portion being removably attachable to one said plurality of support rods so that said table can be selectively moved between up and down positions and pivoted thereabout.

11. The device of claim 10, wherein said front end portion of said support member further comprises:

a female portion and a male portion slidably engageable therein along a substantially parallel path so that said table can be telescopically extended between retracted and extended positions.

12. The device of claim 10, wherein said rear end portion of said support member comprises:

a pair of spaced arms extending outwardly therefrom and along a horizontal plane and for receiving said table therebetween during non-operating conditions.

* * * * *